US008977179B2

(12) United States Patent
McDavid et al.

(10) Patent No.: US 8,977,179 B2
(45) Date of Patent: Mar. 10, 2015

(54) EXTERNALLY HEATED FUSER ASSEMBLY FOR VARIABLE SIZED MEDIA

(71) Applicant: Lexmark International, Inc., Lexington, KY (US)

(72) Inventors: Charles Scott McDavid, Frankfort, KY (US); Benjamin Karnik Johnson, Lexington, KY (US); Paul John Menzel, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 54 days.

(21) Appl. No.: 13/943,870

(22) Filed: Jul. 17, 2013

(65) Prior Publication Data

US 2014/0376980 A1 Dec. 25, 2014

Related U.S. Application Data

(60) Provisional application No. 61/836,904, filed on Jun. 19, 2013.

(51) Int. Cl.
*G03G 15/20* (2006.01)

(52) U.S. Cl.
CPC ..... *G03G 15/2007* (2013.01); *G03G 15/2082* (2013.01); *G03G 15/2017* (2013.01)
USPC ..... 399/334; 399/45; 399/69

(58) Field of Classification Search
CPC ..... G03G 15/2007; G03G 15/2017; G03G 15/2042; G03G 15/2082
USPC ..... 399/45, 69, 329, 334
See application file for complete search history.

(56) References Cited

U.S. PATENT DOCUMENTS 5,113,223 A * 5/1992 Theodoulou et al.
5,708,920 A * 1/1998 Ohnishi et al. ..... 399/69
2007/0019063 A1* 1/2007 Yasuda et al.

FOREIGN PATENT DOCUMENTS

JP 04029280 A * 1/1992 ..... G03G 15/20

OTHER PUBLICATIONS

U.S. Appl. No. 14/024,980, filed Sep. 12, 2013.

* cited by examiner

*Primary Examiner* — David Gray
*Assistant Examiner* — Laura Roth
(74) *Attorney, Agent, or Firm* — Justin M Tromp

(57) ABSTRACT

A fuser assembly for an electrophotographic image forming device according to one example embodiment includes a rotatable fusing member forming a fusing nip with a backup member. A heating lamp is positioned to heat the fusing member. A first reflector is positioned around a circumferential portion of the fusing member and positioned to direct light from the heating lamp onto the fusing member. The first reflector covers a first section of an axial length of the fusing member and does not cover a second section of the axial length of the fusing member. A second reflector is movable between a first position covering at least a portion of the second section of the axial length of the fusing member and a second position uncovering at least a portion of the second section of the axial length of the fusing member.

20 Claims, 6 Drawing Sheets

EXTERNALLY HEATED FUSER ASSEMBLY FOR VARIABLE SIZED MEDIA

CROSS REFERENCES TO RELATED APPLICATIONS

This application claims priority to U.S. Provisional Patent Application Ser. No. 61/836,904, filed Jun. 19, 2013, entitled "Externally Heated Fuser Assembly for Variable Sized Media," the content of which is hereby incorporated by reference in its entirety.

BACKGROUND

1. Field of the Disclosure

The present disclosure relates generally to fusers used in electrophotographic image forming devices and more particularly to an externally heater fuser assembly for variable sized media.

2. Description of the Related Art

In an externally heated fuser assembly for an electrophotographic image forming device, a heating lamp radiates heat onto the outer surface of a fusing roll or belt. The heated fusing roll or belt is pressed against a backup roll or belt forming a fusing nip. The heating lamp extends the full width of the printing process in order to suitably heat and fuse toner to the widest media sheets used with the image forming device. The fusing heat is controlled by measuring the temperature of the fusing roll or belt and feeding the temperature information to a microprocessor-controlled power supply in the image forming device. The power supply applies power to the heating lamp when the temperature sensed drops below a first predetermined level and interrupts power when the temperature exceeds a second predetermined level. In this way, the fuser assembly is maintained at temperature levels suitable for fusing toner to media sheets without overheating.

When printing, the media sheet removes heat from the fuser assembly in the portion of the fuser that contacts the media. When printing on media sheets having widths that are less than the widest media width on which the image forming device is capable of printing, the portion of the fuser assembly beyond the width of the media sheet does not lose heat through the sheet and becomes hotter than the portion of the fuser assembly that contacts the media sheet. In order to prevent thermal damage to components of the fuser assembly, steps are taken to limit the overheating of the portion of the fuser assembly that does not contact narrower media sheets. Typically, the inter-page gap between successive media sheets being printed is increased when media sheets less than the full width are used. However, increasing the inter-page gap between successive media sheets slows the process speed of the image forming device which may lead to customer dissatisfaction. Accordingly, an improved fuser assembly for use with printing on narrower media sheets is desired.

SUMMARY

A fuser assembly for an electrophotographic image forming device according to one example embodiment includes a rotatable fusing member forming a fusing nip with a backup member. A heating lamp is positioned to heat the fusing member. A first reflector is positioned around a circumferential portion of the fusing member and positioned to direct light from the heating lamp onto the fusing member. The first reflector covers a first section of an axial length of the fusing member and does not cover a second section of the axial length of the fusing member. A second reflector is movable between a first position covering at least a portion of the second section of the axial length of the fusing member and a second position uncovering at least a portion of the second section of the axial length of the fusing member.

A fuser assembly for an electrophotographic image forming device according to another example embodiment includes a rotatable fusing member forming a fusing nip with a backup member. A heating lamp is spaced from the fusing member and positioned to supply radiant heat to the fusing member. A first reflector is positioned around a circumferential portion of the fusing member and positioned to direct light from the heating lamp onto the fusing member. The first reflector covers a first section of an axial length of the fusing member extending from a first axial end of the fusing member toward a second axial end of the fusing member. The first reflector does not cover a second section of the axial length of the fusing member near the second axial end of the fusing member. A second reflector is movable toward and away from the second axial end of the fusing member between a first position covering at least a portion of the second section of the axial length of the fusing member and a second position uncovering at least a portion of the second section of the axial length of the fusing member. A heat removal assembly is configured to remove heat collected proximate to the second axial end of the fusing member.

An electrophotographic image forming device according to one example embodiment includes a rotatable fusing member forming a fusing nip with a backup member. A heating lamp is spaced from the fusing member and positioned to supply radiant heat to the fusing member. A first reflector is positioned around a circumferential portion of the fusing member and positioned to direct light from the heating lamp onto the fusing member. The first reflector covers a first section of an axial length of the fusing member extending from a first axial end of the fusing member toward a second axial end of the fusing member. The first reflector does not cover a second section of the axial length of the fusing member near the second axial end of the fusing member. A second reflector is movable toward and away from the 10 second axial end of the fusing member between a first position covering at least a portion of the second section of the axial length of the fusing member and a second position uncovering at least a portion of the second section of the axial length of the fusing member. A controller is configured to move the second reflector toward the first position when printing wider media and to move the second reflector toward the second position when printing narrower media.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
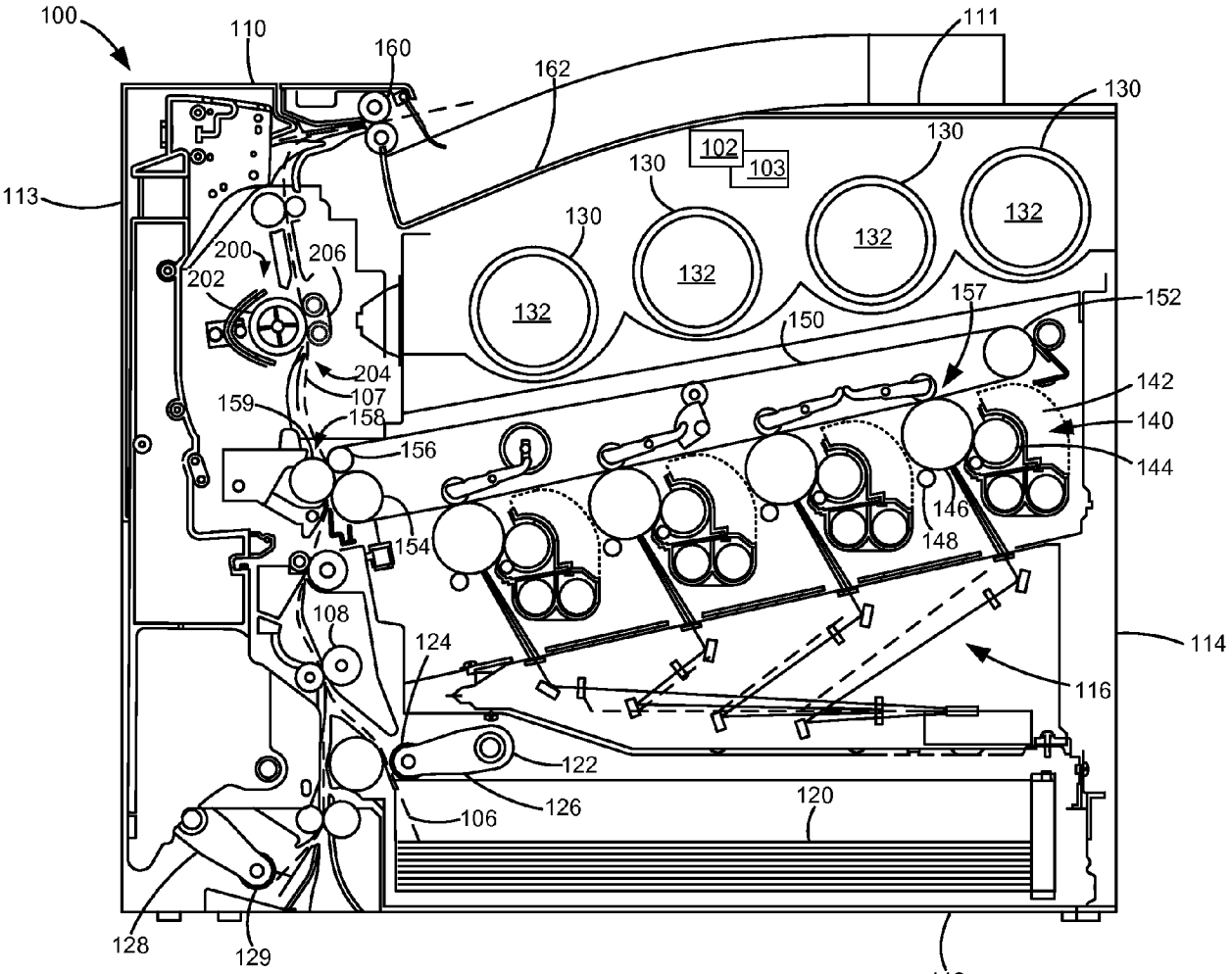
FIG. 1 is a schematic diagram of an image forming device according to one example embodiment.

Referring now to the drawings, and more particularly to FIG. 1, there is shown a schematic view of an example image forming device 100. Image forming device 100 includes a housing 110 having a top 111, bottom 112, front 113 and rear 114. Housing 110 includes one or more media input trays 120 positioned therein. Trays 120 are sized to contain a stack of media sheets. As used herein, the term media is meant to encompass not only paper but also labels, envelopes, fabrics, photographic paper or any other desired substrate. Trays 120 are preferably removable for refilling. A media path 106 extends through image forming device 100 for moving the media sheets through the image transfer process. Media path 106 includes a simplex path 107 and may also include a duplex path as desired. A media sheet is introduced into simplex path 107 from tray 120 by a pick mechanism 122. In the example embodiment shown, pick mechanism 122 includes a roll 124 positioned at the end of a pivotable arm 126. Roll 124 rotates to move the media sheet from tray 120 into media path 106. The media sheet is then moved along media path 106 by various transport rolls 108. Media sheets may also be introduced into media path 106 by a manual feed 128 having one or more rolls 129.

In the example embodiment shown, image forming device 100 includes four toner cartridges (or toner bottles) 130 removably mounted in housing 110 in a mating relationship with four corresponding imaging units 140 also removably mounted in housing 110. For purposes of clarity, the components of only one of the imaging units 140 are labeled in FIG. 1. Each toner cartridge 130 includes a reservoir 132 for holding the main toner supply for image forming device 100 and an outlet port in communication with an inlet port of its corresponding imaging unit 140 for transferring toner from reservoir 132 to a reservoir 142 in the imaging unit 140. For example, in one embodiment toner moves through a chute that connects the outlet port of a toner cartridge 130 to the inlet port of the corresponding imaging unit 140. Toner is transferred periodically from a respective toner cartridge 130 to its corresponding imaging unit 140 in order to replenish the imaging unit 140. In the example embodiment illustrated, each toner cartridge 130 is substantially the same except for the color of toner contained therein. In one embodiment, the four toner cartridges 130 include yellow, cyan, magenta and black toner, respectively.

Each imaging unit 140 includes toner reservoir 142 which holds toner received from the corresponding toner cartridge 130 and a photoconductive drum 146. Photoconductive drums 146 are mounted substantially parallel to each other when the imaging units 140 are installed in image forming device 100. In the example embodiment illustrated, each imaging unit 140 is substantially the same except for the color of toner contained therein. Each photoconductive drum 146 forms a nip with a corresponding charging roll 148. During a print operation, charging roll 148 charges the surface of photoconductive drum 146 to a specified voltage such as, for example, −1000 volts. A laser beam from a laser scan unit 116 is then directed to the surface of each photoconductive drum 146 and selectively discharges those areas it contacts to form a latent image. In one embodiment, areas on photoconductive drum 146 illuminated by the laser beam are discharged to a specified voltage, such as approximately −300 volts. Toner stored in reservoir 142 is applied to the areas of the surface of photoconductive drum 146 discharged by the laser beam from LSU 116 to form a toned image on the surface of photoconductive drum 146.

In one embodiment, imaging units 140 utilize a dual component development system. In this embodiment, the toner in each reservoir 142 is mixed with magnetic carrier beads. The magnetic carrier beads may be coated with a polymeric film to provide triboelectric properties to attract toner to the carrier beads as the toner and the magnetic carrier beads are mixed in reservoirs 142. Magnetic rolls 144 attract the magnetic carrier beads having toner thereon to magnetic roll 144 through the use of magnetic fields and transfer toner to the areas on the surface of the photoconductive drum 146 discharged by the laser beam from LSU 116.

In another embodiment, imaging units 140 utilize a single component development system. In this embodiment, each imaging unit 140 includes a toner adder roll and a developer roll. The toner adder roll moves toner from reservoir 142 to the developer roll. A metering device such as a doctor blade meters toner onto the developer roll and applies a desired charge on the toner. The developer roll forms a nip with the photoconductive drum 146 of the imaging unit 140 and transfers toner to the areas on the surface of the photoconductive drum 146 discharged by the laser beam from LSU 116.

An intermediate transfer mechanism (ITM) 150 is disposed adjacent to the photoconductive drums 146. ITM 150 is formed as an endless belt trained about a drive roll 152 and backup rolls 154, 156. During image forming operations, ITM 150 moves past photoconductive drums 146 in a clockwise direction as viewed in FIG. 1. One or more of photoconductive drums 146 apply toner images in their respective colors to ITM 150 at a first transfer nip 157. In one embodiment, a positive voltage field attracts the toner image from photoconductive drums 146 to the surface of the moving ITM 150. ITM 150 rotates and collects the one or more toner images from photoconductive drums 146 and then conveys the toner images to a media sheet at a second transfer nip 158 formed by a transfer roll 159 and backup rolls 154, 156.

A media sheet advancing through simplex path 107 receives the toner image from ITM 150 as it moves through the second transfer nip 158. The media sheet with the toner image is then moved along the media path 106 and into a fuser 200. As discussed in greater detail below, fuser 200 includes a fusing roll (or belt) 202 that forms a fusing nip 204 with a backup belt (or roll) 206. In general terms, fuser 200 applies heat and pressure to the media sheets to adhere the toner image to the media sheet. The fused media sheet then passes through exit rolls 160 located downstream from fuser 200. In some embodiments, exit rolls 160 may be rotated in either forward or reverse directions. In a forward direction, exit rolls 160 move the media sheet from simplex path 107 to an output area 162 on top 111 of image forming device 100. In a reverse direction, exit rolls 160 move the media sheet into a duplex path as desired for image formation on a second side of the media sheet.

While the example image forming device 100 shown in FIG. 1 illustrates four toner cartridges 130 and four corresponding imaging units 140, it will be appreciated that a monocolor image forming device 100 may include a single toner cartridge 130 and corresponding imaging unit 140 as compared to a color image forming device 100 that may include multiple toner cartridges 130 and imaging units 140. Further, although image forming device 100 illustrated utilizes ITM 150 to transfer toner to the media, toner may be applied directly to the media by the one or more photoconductive drums 146 as is known in the art. It will be appreciated that the configurations and architectures of toner cartridge 130 and imaging unit 140 are merely provided as examples and are not intended as limiting. Other configurations and architectures may be used as desired. For example, toner cartridge 130 and imaging unit 140 may be formed as a single replaceable unit instead of separate replaceable units or each imaging unit 140 may be split into multiple replaceable units. Further, one or more components housed in imaging unit 140 may instead be housed in toner cartridge 130 or vice versa. For example, toner cartridge 130 may include reservoir 132, a toner adder roll and a developer roll forming a first replaceable unit and imaging unit 140 may include photoconductive drum 146 and a waste toner removal system forming a second replaceable unit.

Image forming device 100 includes a controller 102. Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 controls the operation of image forming device 100 and processes print data. As desired, image forming device 100 may include an integrated scanner system for document scanning and copying. In this embodiment, controller 102 may be a combiner printer and scanner controller. It is understood that controller 102 may be implemented as any number of controllers and/or processors for suitably controlling image forming device 100 to perform, among other functions, printing operations.

In one embodiment, image forming device 100 includes a user interface (not shown) mounted on an exterior portion of housing 110. Using the user interface, a user is able to enter commands and generally control the operation of the image forming device 100. For example, the user may enter commands to switch modes (e.g., color mode, monochrome mode), view the number of pages printed, etc.

Figure 2:
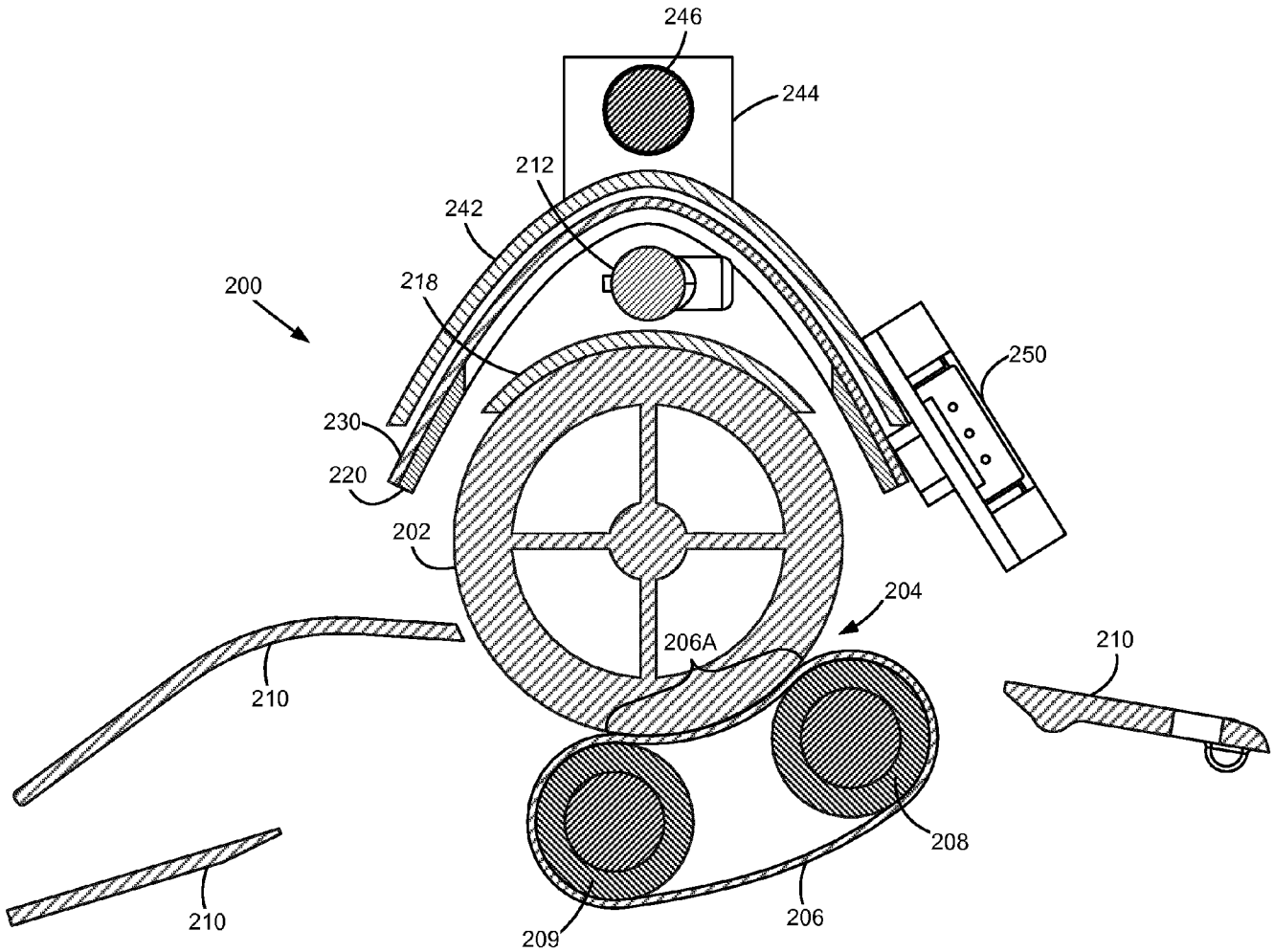
FIG. 2 is a side cross-sectional view of an externally heated fuser assembly according to one example embodiment.

FIG. 2 shows a cross-sectional view of fuser 200 according to one example embodiment. Fusing nip 204 of fuser 200 is formed between fusing roll 202 and backup belt 206. Fusing roll 202 may include a metallic core covered with an elastomeric layer, such as silicone rubber, and a fluororesin release layer, such as may be formed, for example, by a spray coated PFA (polyperfluoroalkoyx-tetrafluoroethylene) layer, a PFA-PTFE (polytetrfluoroethylene) blended layer, or a PFA sleeve. Backup belt 206 is an endless belt trained about backup rolls 208, 209. Backup belt 206 may include a stainless steel tube; an elastomeric layer, such as silicone rubber layer, covering the stainless steel tube; and a release layer, such as PFA, sleeve or coating covering the elastomeric layer. The release layers of fusing roll 202 and backup belt 206 are formed on the respective outer surfaces of fusing roll 202 and backup belt 206 so as to contact media sheets passing between fusing roll 202 and backup belt 206. The release layers prevent contamination from toner particles. Backup belt 206 is biased against fusing roll 202 to apply pressure to a media sheet passing through fusing nip 204 to fuse the toner to the media sheet. As shown in FIG. 2, the bias of backup belt 206 causes a portion 206A of backup belt 206 to bend and conform to the shape of the outer surface of fusing roll 202 increasing the surface area of backup belt 206 in contact with fusing roll 202 to ensure sufficient contact between fusing roll 202 and a media sheet passing through fusing nip 204. One or more media guides 210 may be positioned upstream and/or downstream from fusing nip 204 to guide the media into fusing nip 204 and from fusing nip 204 to transport rolls that continue to feed the media along media path 106.

Figure 3:
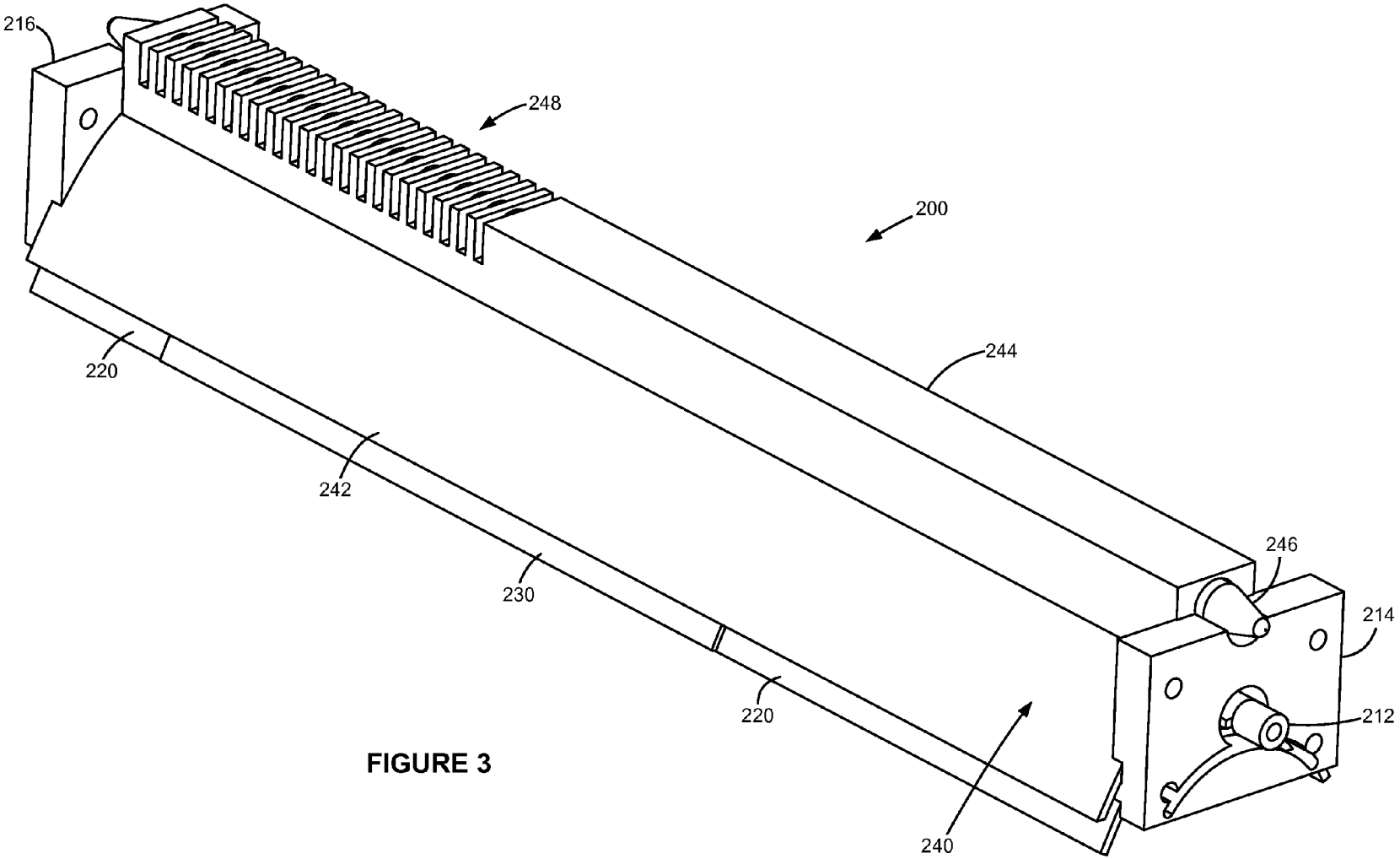
FIG. 3 is a front perspective view of the fuser assembly according to one example embodiment.
Figure 4:
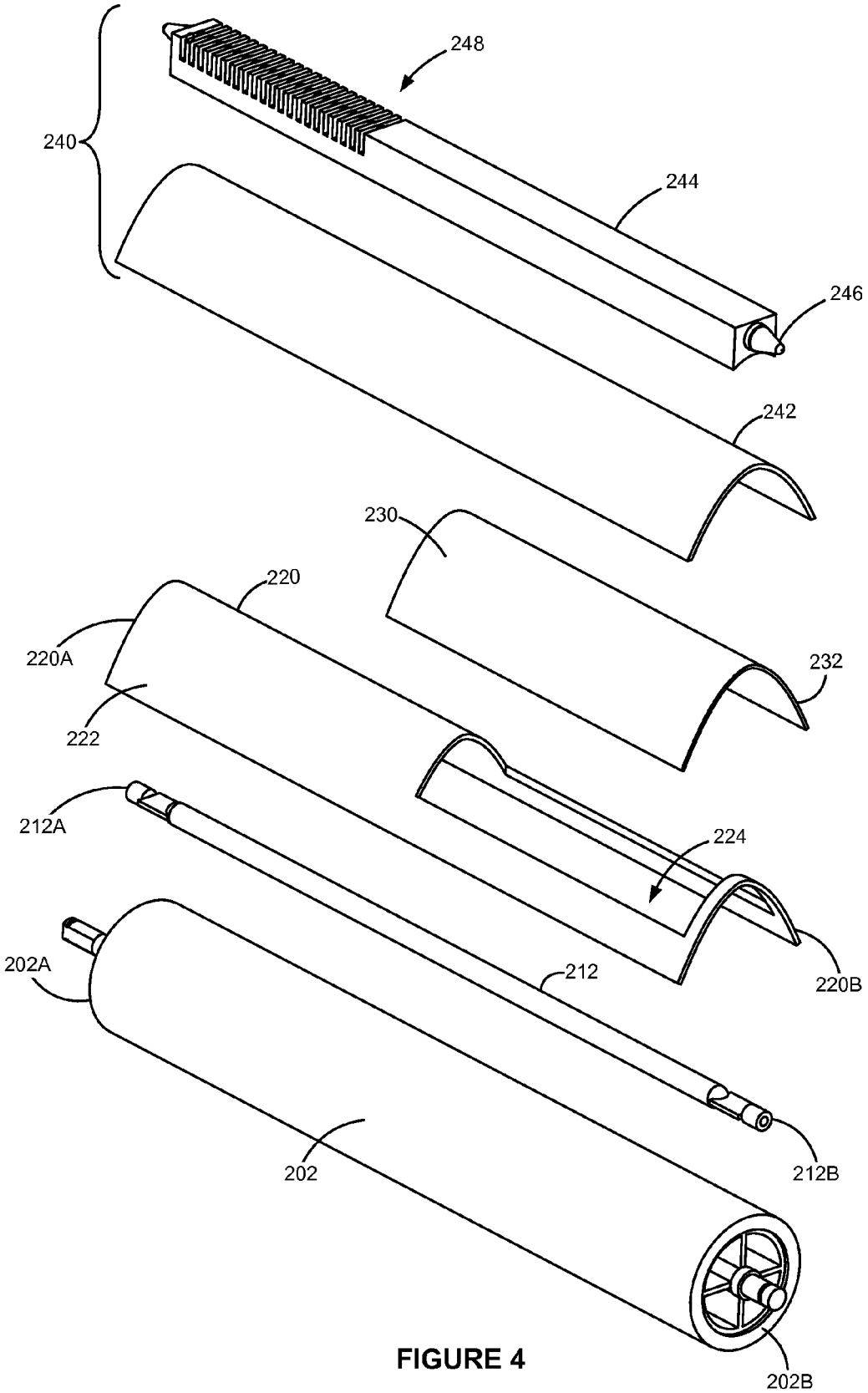
FIG. 4 is an exploded view of the fuser assembly shown in FIG. 3.

With reference to FIGS. 2-4, a lamp 212 positioned on the non-contact side of fusing roll 202 (as opposed to the contact side of fusing roll 202 that contacts backup belt 206) supplies radiant heat to fusing roll 202 to maintain fusing roll 202 within a desired temperature range. The heated fusing roll 202 fuses the toner to media sheets passing through fusing nip 204. In one embodiment, lamp 212 includes a halogen bulb that is spaced from the outer surface of fusing roll 202 on the non-contact side of fusing roll 202 and that extends substantially the entire axial length of fusing roll 202 from a first end 202A of fusing roll 202 to a second end 202B. As shown in FIG. 3, lamp 212 may be supported at its ends 212A, 212B (FIG. 4) by end caps 214, 216. As shown in FIG. 2, a substantially transparent (e.g., quartz) media shield 218 may be positioned between lamp 212 and fusing roll 202 in order to prevent a misfed media sheet from contacting lamp 212.

A first reflector 220 having a highly reflective inner surface (i.e., the surface facing fusing roll 202) wraps around lamp 212 and the non-contact side of fusing roll 202 to redirect light emitted by lamp 212 toward fusing roll 202. Reflector 220 extends along the axial length of fusing roll 202 from end 202A of fusing roll 202 toward end 202B. Reflector 220 does not cover at least a portion of the axial length of fusing roll 202 near end 202B. A second reflector 230 having a highly reflective inner surface is movable between a first position covering the portion of fusing roll 202 near end 202B uncovered by reflector 220 and a second position uncovering the portion of fusing roll 202 near end 202B uncovered by reflector 220. Reflector 230 is selectively movable between the first position and the second position including positions intermediate the first and second positions to allow heat accumulating near end 202B of fusing roll 202 to escape to a heat removal assembly 240.

Figure 5:
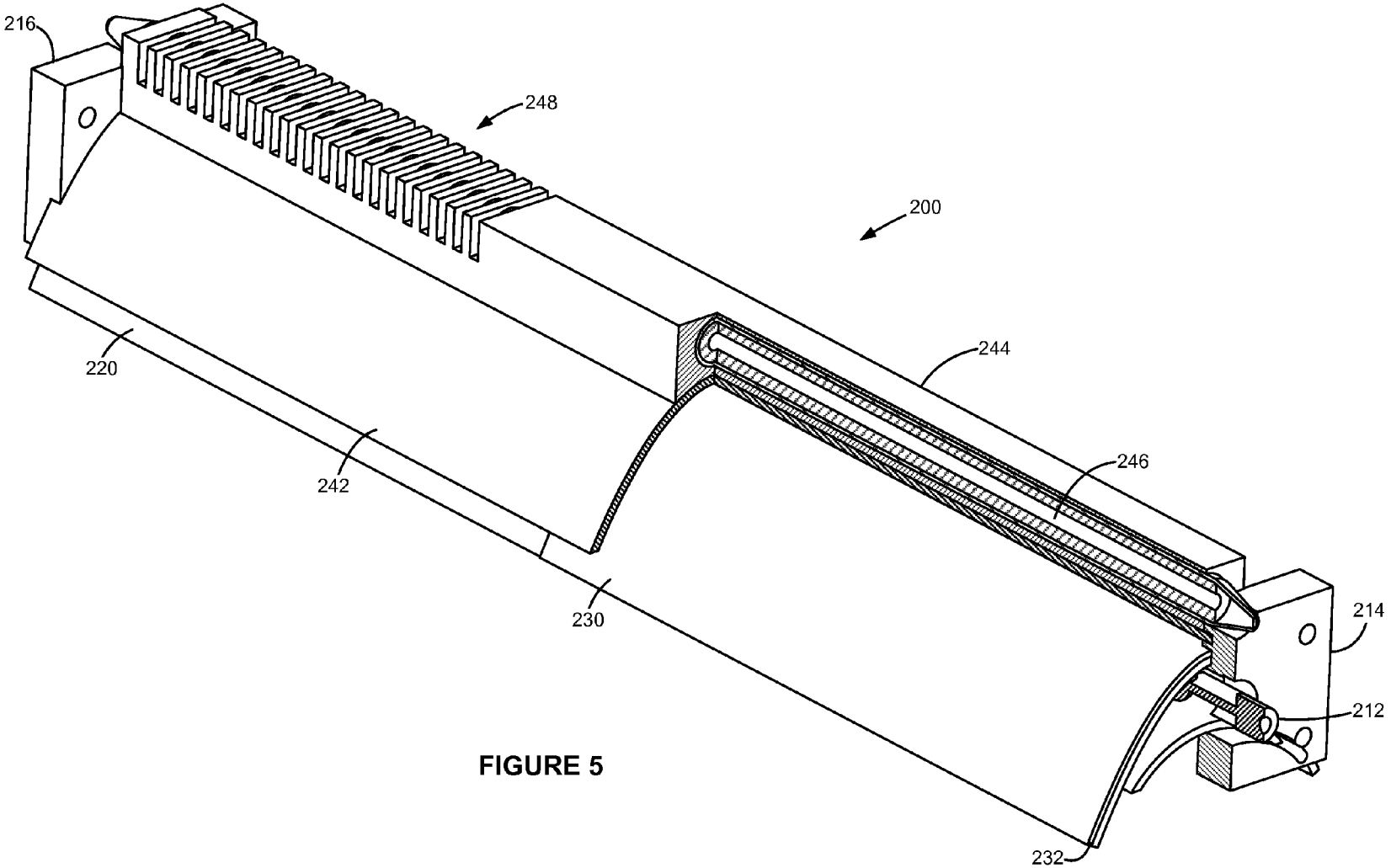
FIG. 5 is a cutaway view of the fuser assembly shown in FIG. 3 showing a movable reflector in a closed position for wide media according to one example embodiment.
Figure 6:
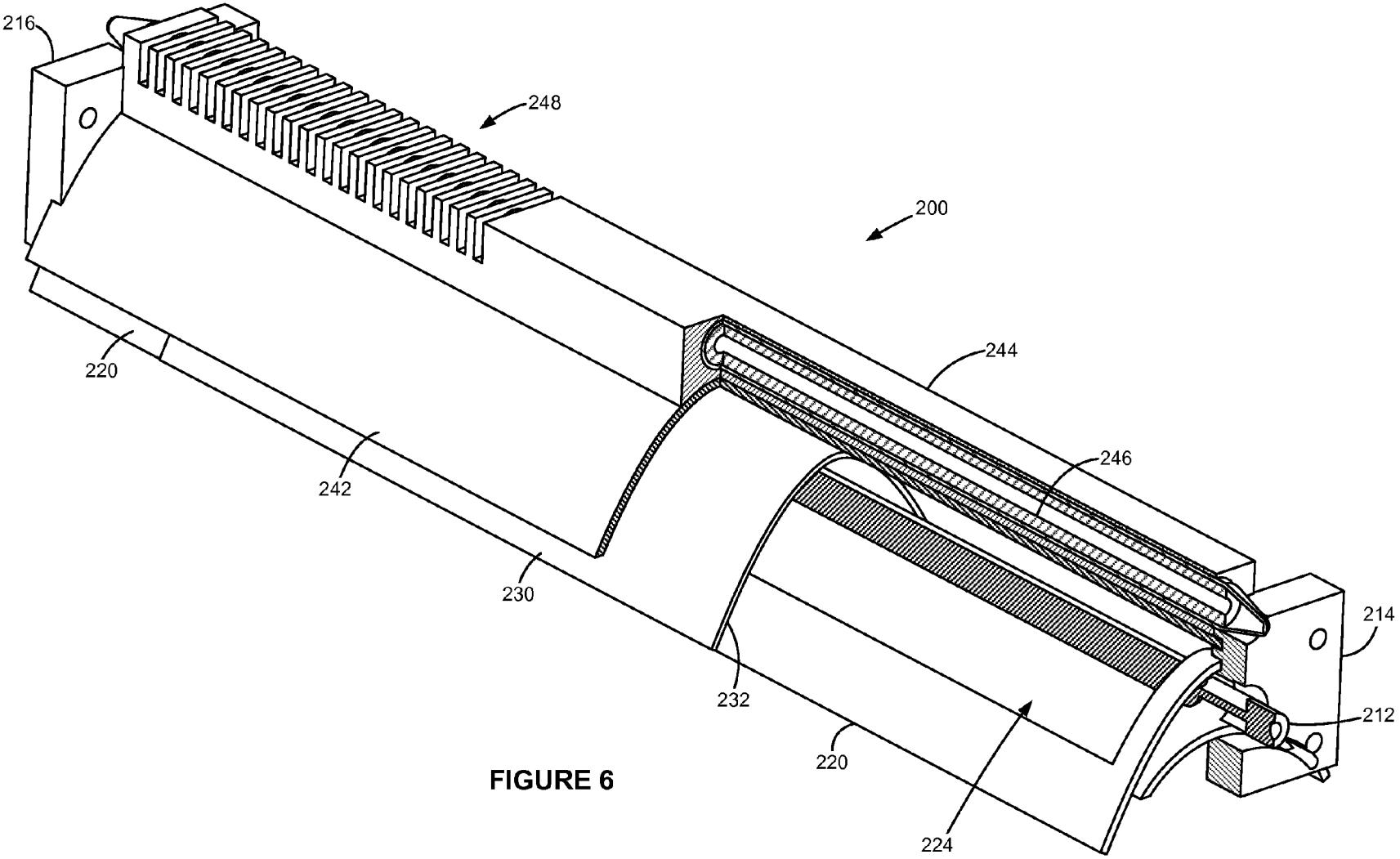
FIG. 6 is a cutaway view of the fuser assembly shown in FIG. 3 showing the movable reflector in an open position for narrow media according to one example embodiment.

In the example embodiment shown in FIG. 4, reflector 220 extends substantially the entire axial length of fusing roll 202 and includes a solid portion 222 and an aperture 224 formed in reflector 220. Solid portion 222 extends from one end 220A of reflector 220 toward the other end 220B of reflector 220. Aperture 224 is formed as a cutout in reflector 220 near end 220B of reflector 220. Aperture 224 extends from near end 220B along the length of reflector 220 to solid portion 222. In one embodiment, reflector 220 is mounted in a substantially fixed position relative to lamp 212. With reference to FIGS. 5 and 6, fuser 200 is shown with a portion of heat removal assembly 240 cut away to more clearly illustrate the operation of reflector 230. FIG. 5 shows reflector 230 in a closed position covering aperture 224 of reflector 220 blocking heat from escaping fusing roll 202 toward heat removal assembly 240. FIG. 6 shows reflector 230 slid to the left as viewed in FIG. 6 in an open position uncovering aperture 224 of reflector 220 in order to permit heat accumulating near end 202B of fusing roll 202 to escape to heat removal assembly 240. In an alternative embodiment, the length of reflector 220 is less than the length of fusing roll 202 and reflector 220 extends from end 202A of fusing roll 202 toward, but not all the way to, end 202B of fusing roll 202. In this embodiment, reflector 230 is movable between a closed position covering the gap between reflector 220 and end 202B of fusing roll 202 and an open position exposing at least a portion of the gap between reflector 220 and end 202B of fusing roll 202. Any suitable actuation mechanism may be used to move reflector 230 toward and away from end 202B of fusing roll 202. For example, reflector 230 may be driven by an electric motor and gear system or actuated by a solenoid.

In one embodiment, the inner surfaces of reflector 220 and reflector 230 are parabolic in cross-section along the axial length of fusing roll 202 and lamp 212. It is believed that a parabolic shape distributes the light from lamp 212 across the outer circumference of the non-contact side of fusing roll 202 exposed to reflectors 220 and 230. In contrast, an elliptical reflective surface may tend to focus the light from lamp 212 along a thin band running the axial length of fusing roll 202 potentially damaging fusing roll 202 if fusing roll 202 is not rotating while lamp 212 is on. For example, a thin band exposure may result in a "sunburn" condition where a gloss streak is formed on the outer surface along the axial length of fusing roll 202. However, the reflective surfaces of reflector 220 and 230 may take any suitable cross-sectional shape provided that light from lamp 212 is not focused on the outer surface of fusing roll 202 in a manner that damages fusing roll 202.

With reference back to FIG. 3, in the example embodiment illustrated, the inner surface of each end cap 214, 216 is also reflective in order to redirect light from lamp 212 toward fusing roll 202. In this manner, the amount of light wasted from lamp 212 (i.e., the amount of light not used for heating fusing roll 202) is minimized. Belt and hot roll fuser assemblies commonly utilize a lamp having increased illumination at its axial ends in order to provide relatively uniform heating across the axial length of the fusing roll. The reflective inner surfaces of end caps 214, 216 may eliminate the need for greater illumination at the axial ends of lamp 212 permitting substantially uniform illumination along the length of lamp 212 thereby reducing the cost of lamp 212.

With reference to FIGS. 2-4, heat removal assembly 240 includes a heat collector 242 that wraps around the exterior of reflectors 220 and 230. Collector 242 is composed of a thermally conductive material and possesses a high emissivity (e.g., $\epsilon > \sim 0.96$). For example, in one embodiment, collector 242 is composed of black, high temperature painted aluminum. Collector 242 shrouds reflectors 220 and 230 in order to absorb the radiate heat transfer from lamp 212. Collector 242 is in turn adjoined to a heat sink 244 that transfers the heat away from fusing roll 202. In the embodiment illustrated, heat sink 244 includes a heat pipe 246 that transfers heat energy collected at end 202B of fusing roll 202 toward a convective fin arrangement 248 where air flow from a fan mounted in image forming device 100 removes the heat energy from fuser 200. Heat pipes are known to transfer heat using thermal conductivity and phase transition. In general terms, heat pipe 246 may include a vessel in which its inner walls are lined with a wick structure. When the heat pipe is heated at one end (near end 202B), the working fluid therein evaporates and changes phase from liquid to vapor. The vapor travels toward the cool end (toward end 202A of fusing roll 202) through the hollow core of the heat pipe and back to the hot end (toward end 202B of fusing roll 202) via the wick structure by capillary action and is then available to repeat the heat transfer process. In the example embodiment illustrated, convective fin arrangement 248 is positioned on a portion of heat sink 244 proximate to end 202A of fusing roll 202. In another embodiment, convective fin arrangement 248 is spaced away from fuser 200 and may be positioned in a remote location with respect to fuser 200 within image forming device 100 in order to provide a more convenient placement for convective fin arrangement 248 and the associated fan and airflow. In this embodiment, heat pipe 246 extends from heat sink 244 through image forming device 100 and connects to convective fin arrangement 248 in order to transfer heat from heat sink 244 to convective fin arrangement 248. Thermal grease or gel may be used in any gaps between collector 242 and heat sink 244 or within heat sink 244 in order to improve the thermal dissipation. To the extent possible, the components of collector 242 and heat sink 244 are formed integrally in order to promote heat transfer.

With reference back to FIGS. 5 and 6, in one embodiment, the position of reflector 230 is based on the width of the media passing through fusing nip 204. For the widest media supported by image forming device 100, reflector 230 is positioned adjacent to end 202B of fusing roll 202 covering aperture 224 of reflector 220 in order to uniformly heat fusing roll 202 along the entire length of fusing roll 202. As discussed above, when printing media that is narrower than the widest media supported by image forming device 100, the portion of fusing roll 202 beyond the width of the media does not lose heat through the sheet and becomes hotter than the portion of fusing roll 202 that contacts the media sheet. Accordingly, for media that is narrower than the widest media supported, reflector 230 may be moved to uncover a portion of fusing roll 202 (e.g., via aperture 224) in order to permit heat accumulating near end 202B of fusing roll 202 to escape. For example, reflector 230 may be moved to align an edge 232 of reflector 230 with the edge of the media passing through fusing nip 204 in order to permit heat accumulating beyond the width of the media to escape. For example, if the widest media supported by image forming device 100 is letter sized media and A4 media, which is 6 mm narrower than letter sized media, is printed reflector 230 may be moved to align edge 232 with the edge of the A4 media, which is spaced inward from end 202B of fusing roll 202. With reflector 230 slid away from end 202B of fusing roll 202, heat is permitted to radiate to collector 242 (instead of being reflected back onto fusing roll 202) and ultimately to heat pipe 246 which transfers the heat to convective fin arrangement 248 where the heat is removed by passing air. As a result, image forming device 100 is permitted to print narrow media at normal process speeds for an improved period of time.

Reflector 230 may change positions in response to any suitable input or condition. The position of reflector 230 may be based on a command received at the user interface. For example, a user may select the media size to be printed on and reflector 230 may move to a predetermined positioned based on the media size selected. The media selection may be communicated to controller 102 and controller 102 may then control the operation of the actuation mechanism that positions reflector 230. The position of reflector 230 may also be based on the size of the media being printed such as by sensing the size of the media in the media input tray 120 from which media sheets are fed for printing or by sensing the size of the media traveling along media path 106. For example, it is common for media input trays 120 to include one or more manually movable media walls that are positioned at the edges of a stack of media sheets in order to maintain a neatly aligned stack. Positioning sensors may be used to communicate the position(s) of the media wall(s) to controller 102. Controller 102 may then use this positional information to determine the media size and position reflector 230 accordingly. The position of reflector 230 may also be based on temperature data received from one or more temperature sensors 250 (FIG. 2), e.g., one or more non-contact thermistors, positioned along fusing roll 202. For example, temperature sensor(s) 250 may be used to determine when the temperature near end 202B of fusing roll 202 is greater than the temperature near end 202A of fusing roll 202 or at other points along fusing roll 202 indicating that narrow media is being printed. This temperature information may be communicated to controller 102 and controller 102 may adjust the position of reflector 230 in order to permit excess heat to dissipate near end 202B of fusing roll 202. Alternatively, the temperature information may indicate that too much heat is dissipating near end 202B prompting controller 102 to close reflector 230 in order to prevent end 202B of roll 202 from cooling excessively. In general terms, when the temperature sensed drops below a first predetermined level, lamp 212 is turned on to heat fusing roll 202 and when the temperature exceeds a second predetermined level, lamp 212 is turned off. These temperature settings are typically based on power considerations of image forming device 100 as well as the properties of the toner being used (e.g., the melting properties of the toner).

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A fuser assembly for an electrophotographic image forming device, comprising:

a rotatable fusing member forming a fusing nip with a backup member, a heating lamp positioned to heat the fusing member;

a first reflector positioned around a circumferential portion of the fusing member and positioned to direct light from the heating lamp onto the fusing member, the first reflector covering a first section of an axial length of the fusing member and not covering a second section of the axial length of the fusing member; and a second reflector movable between a first position covering at least a portion of the second section of the axial length of the fusing member and a second position uncovering at least a portion of the second section of the axial length of the fusing member.

2. The fuser assembly of claim 1, wherein the first reflector is stationary relative to the heating lamp and the second reflector is slidably movable relative to the first reflector.

3. The fuser assembly of claim 1, wherein the first section of the axial length of the fusing member extends from a first axial end of the fusing member toward a second axial end of the fusing member and the second section of the axial length of the fusing member is positioned near the second axial end of the fusing member.

4. The fuser assembly of claim 1, wherein the first reflector includes a solid first portion covering the first section of the axial length of the fusing member and a second portion having an aperture positioned over the second section of the axial length of the fusing member.

5. The fuser assembly of claim 1, wherein reflecting surfaces of the first reflector and the second reflector have a parabolic cross sectional shape.

6. The fuser assembly of claim 1, further comprising a first end cap mounted at a first axial end of the fusing member and a second end cap mounted at a second axial end of the fusing member, the heating lamp being mounted to the first and second end caps and the first and second end caps each having a reflective inner surface positioned to direct light from the heating lamp onto the fusing member.

7. The fuser assembly of claim 1, further comprising a heat removal assembly configured to remove heat collected proximate to the second section of the axial length of the fusing member.

8. The fuser assembly of claim 7, wherein the heat removal assembly includes a heat pipe configured to move heat away from the second section of the axial length of the fusing member.

9. The fuser assembly of claim 8, wherein the heat removal assembly includes a thermally conductive and emissive shroud wrapped around an outer side of the first reflector and an outer side of the second reflector and connected to the heat pipe to transfer heat to the heat pipe.

10. The fuser assembly of claim 8, wherein the heat removal assembly includes a convective fin arrangement positioned to receive heat from the heat pipe for removal by airflow from a fan of the image forming device.

11. A fuser assembly for an electrophotographic image forming device, comprising:

a rotatable fusing member forming a fusing nip with a backup member, a heating lamp spaced from the fusing member and positioned to supply radiant heat to the fusing member, a first reflector positioned around a circumferential portion of the fusing member and positioned to direct light from the heating lamp onto the fusing member, the first reflector covering a first section of an axial length of the fusing member extending from a first axial end of the fusing member toward a second axial end of the fusing member, the first reflector not covering a second section of the axial length of the fusing member near the second axial end of the fusing member, a second reflector movable toward and away from the second axial end of the fusing member between a first position covering at least a portion of the second section of the axial length of the fusing member and a second position uncovering at least a portion of the second section of the axial length of the fusing member; and a heat removal assembly configured to remove heat collected proximate to the second axial end of the fusing member.

12. The fuser assembly of claim 11, wherein the first reflector is stationary relative to the heating lamp and the second reflector is slidably movable relative to the first reflector.

13. The fuser assembly of claim 11, wherein the first reflector includes a solid first portion covering the first section of the axial length of the fusing member and a second portion having an aperture positioned over the second section of the axial length of the fusing member.

14. The fuser assembly of claim 11, wherein reflecting surfaces of the first reflector and the second reflector have a parabolic cross sectional shape.

15. The fuser assembly of claim 11, further comprising a first end cap mounted at the first axial end of the fusing member and a second end cap mounted at the second axial end of the fusing member, the heating lamp being mounted to the first and second end caps and the first and second end caps each having a reflective inner surface positioned to direct light from the heating lamp onto the fusing member.

16. The fuser assembly of claim 11, wherein the heat removal assembly includes a heat pipe configured to move heat away from the second axial end of the fusing member.

17. The fuser assembly of claim 16, wherein the heat removal assembly includes a thermally conductive and emissive shroud wrapped around an outer side of the first reflector and an outer side of the second reflector and connected to the heat pipe to transfer heat to the heat pipe.

18. The fuser assembly of claim 16, wherein the heat removal assembly includes a convective fin arrangement positioned to receive heat from the heat pipe for removal by airflow from a fan of the image forming device.

19. An electrophotographic image forming device, comprising:

a rotatable fusing member forming a fusing nip with a backup member, a heating lamp spaced from the fusing member and positioned to supply radiant heat to the fusing member, a first reflector positioned around a circumferential portion of the fusing member and positioned to direct light from the heating lamp onto the fusing member, the first reflector covering a first section of an axial length of the fusing member extending from a first axial end of the fusing member toward a second axial end of the fusing member, the first reflector not covering a second section of the axial length of the fusing member near the second axial end of the fusing member, a second reflector movable toward and away from the second axial end of the fusing member between a first position covering at least a portion of the second section of the axial length of the fusing member and a second position uncovering at least a portion of the second section of the axial length of the fusing member; and a controller configured to move the second reflector toward the first position when printing wider media and to move the second reflector toward the second position when printing narrower media.

20. The electrophotographic image forming device of claim 19, wherein the controller is configured to move the second reflector based on at least one of a sensed width of the media being printed, a received user input of the width of the media being printed and a sensed temperature along the fusing member.

* * * * *